United States Patent [19]

Schock

[11] Patent Number: 4,872,022

[45] Date of Patent: Oct. 3, 1989

[54] SUPPORT AND CONNECTION MEANS FOR LOOPED ANTENNA CONDUCTORS

[76] Inventor: Edward J. Schock, 1000 Conestoga Rd. C-347, Rosemont, Pa. 19010

[21] Appl. No.: 38,425

[22] Filed: Apr. 9, 1987

Related U.S. Application Data

[63] Continuation-in-part of Ser. No. 708,225, Mar. 5, 1985, abandoned.

[51] Int. Cl.[4] ..... H01Q 11/14

[52] U.S. Cl. ..... 343/806; 343/878; 343/891

[58] Field of Search ..... 343/742, 743, 792.5, 343/796, 806, 866, 867, 869, 870, 878, 888, 890–892, 895, 741, 905, 908

[56] References Cited

U.S. PATENT DOCUMENTS

| | | | |
|---|---|---|---|
| 1,775,826 | 9/1930 | Nixdorff | 343/806 |
| 2,245,246 | 6/1941 | Alexanderson | 343/806 |
| 2,759,183 | 8/1956 | Woodward | 343/908 |
| 2,875,441 | 2/1959 | McGrane | 343/806 |
| 2,918,672 | 12/1959 | Hoverman | 343/806 X |
| 3,167,775 | 1/1965 | Guertler | 343/806 |
| 3,363,255 | 1/1968 | Nienaber | 343/890 |
| 3,369,246 | 2/1968 | Fisk et al. | 343/806 |
| 3,375,525 | 3/1968 | Fisk et al. | 343/806 X |
| 3,409,893 | 11/1968 | Siukola | 343/836 |
| 3,434,145 | 3/1969 | Wells | 343/792.5 |
| 3,541,564 | 11/1970 | Fisk | 343/806 |
| 3,587,105 | 9/1971 | Neilson | 343/806 X |
| 3,683,393 | 8/1972 | Self | 343/806 |
| 3,716,861 | 2/1973 | Root | 343/806 X |
| 4,087,824 | 5/1978 | Alford | 343/806 |
| 4,250,509 | 2/1981 | Collins | 343/806 |

FOREIGN PATENT DOCUMENTS

| | | | |
|---|---|---|---|
| 453485 | 12/1948 | Canada | 343/806 |
| 378226 | 1/1940 | Italy | 343/742 |
| 836350 | 6/1960 | United Kingdom | 343/878 |

OTHER PUBLICATIONS

DuHamel, "TV and RF Transmitting Antennas," p. 28–16, in *Antenna Engineering Handbook,* 2d. Ed., edited by Johnson and Vasik (McGraw-Hill, 1984).

Bob Eldridge, "The Lazy U Dipole," *73 Amateur Radio,* Sep. 1986 (ISSN 0745-080X), pp. 64–65, WGE Center Peterborough, NH 03458-9995.

*Primary Examiner*—Rolf Hille

*Assistant Examiner*—Michael C. Wimer

[57] ABSTRACT

Antenna of wire-like conductors, wherein two notched clamping devices snap-connect to a central post and hold a non-conductive flanged disk against said post. A notch in each clamping device extends over a perimeter flange of said disk. The antenna conductors, which are looped across and fastened to said post, have ends that are inserted through apertures in said disk into alligator clips attached to twin-lead transmission line.

4 Claims, 5 Drawing Sheets

SUPPORT AND CONNECTION MEANS FOR LOOPED ANTENNA CONDUCTORS

SUMMARY OF THE INVENTION

This is a Continuation-In-Part of Ser. No. 06/708,225, which was filed on Mar. 5, 1985, abandoned.

This invention relates to a cooperative means of supporting looped antenna conductors in a feed region a fixed distance from a central post and connecting said conductors to a balanced feed line.

The invention particularly relates to antennas useful for Ultra High Frequency television reception.

An object is to create an antenna of simple design that is easily and inexpensively fabricated.

Another object is to create a simple means of attaching a transmission line to the antenna in a manner that minimizes formation of voltage standing waves.

Another object is to adapt to a novel use the flanged plastic disks that are normally used as resealable container lids.

In the present invention, two notched clamping devices snap-connect to a central post and hold a non-conductive flanged disk against the central post. A notch in each of the two clamping devices extends over a perimeter flange of the flanged disk. The flanged disk has two apertures through it, one on each side of the central post. Wire-like antenna conductors that are looped across and fastened to the central post have ends that are inserted through the apertures in the flanged disk into the throats of alligator clips that are attached to the leads of twin-lead transmission line.

DETAILED DESCRIPTION

Figure 1:
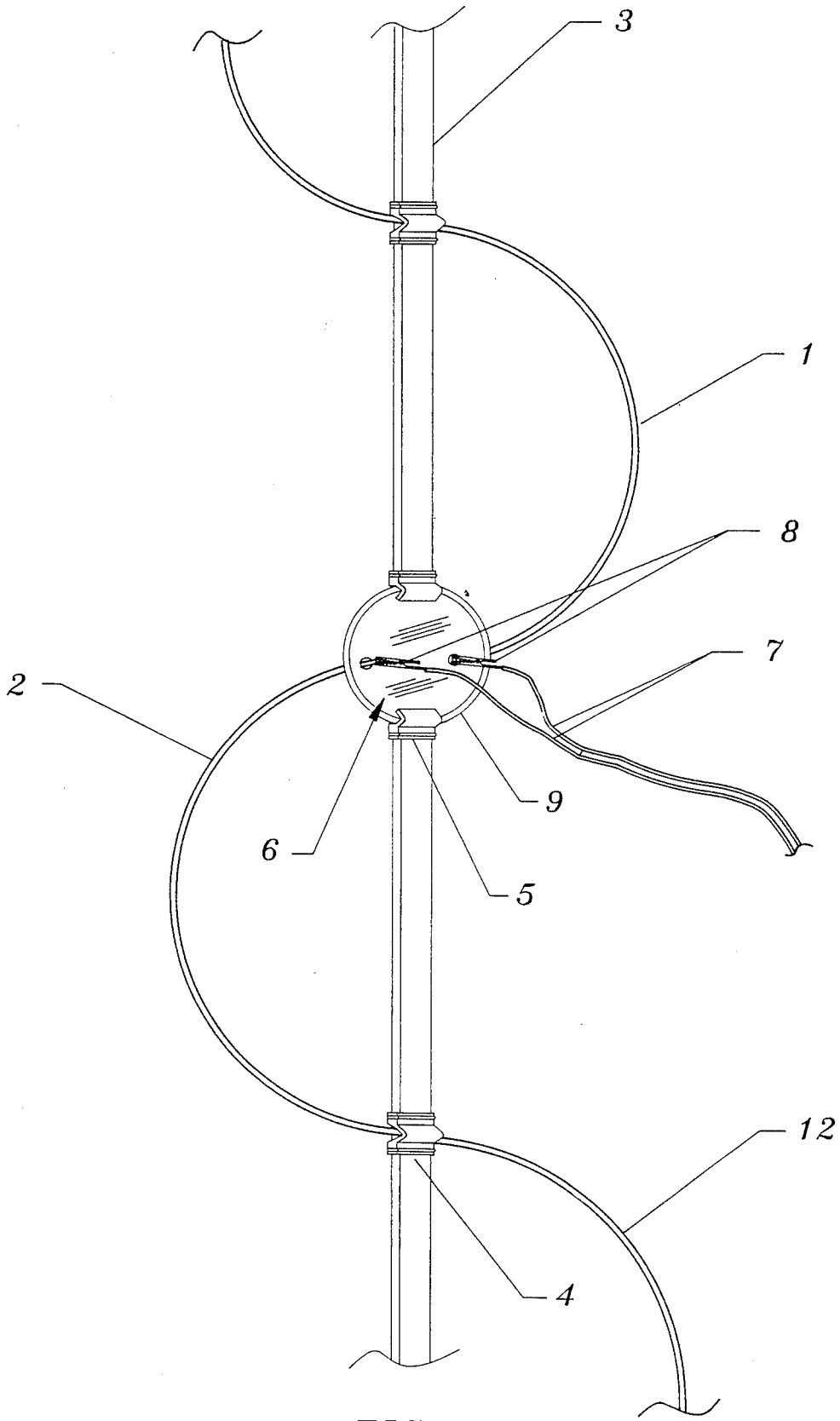
FIG. 1 is a front perspective view of a portion of an antenna incorporating the present invention.

Referring to FIG. 1, half loop 1 is a section of a wire-like antenna conductor curved outward from a point of attachment on central post 3 to an apex removed from said post and then curved back to a feed region where an end section of half loop 1 is bent forward and inserted end-first through an aperture in flanged disk 6 into the throat of an alligator clip 8 that is attached to a lead 7 of a balanced, twin-lead transmission line. Half loop 2 is a section of a wire-like antenna conductor curved outward from a point of attachment on central post 3 to an apex removed from said post and then curved back to the feed region where an end section of half loop 2 is bent forward and inserted end-first through an aperture in flanged disk 6 into the throat of an alligator clip 8 that is attached to the other lead 7 of the twin-lead transmission line. The flanged disk 6, which generally defines the feed region, has two substantially flat surfaces of circular perimeter that are separated from each other by the thickness of the disk. One of the two substantially flat surfaces of the flanged disk 6 is placed against the central post 3 such that the post extends along a diameter of the circular perimeter of the disk. The other substantially flat surface has its circular perimeter edge raised perpendicular to it, forming a perimeter flange 9. The flanged disk 6 is fastened to the central post 3 by two notched clamping devices 5 that are snap-connected to the central post 3. Each clamping device 5 has a notched portion that extends over the perimeter flange 9. The notch of the clamping device 5 lies transverse to the length of the central post 3. The perimeter flange 9 is held within the notch of each of the two clamping devices 5.

As shown in FIG. 1, each of half loops 1 and 2 is a curved section of antenna conductor that extends from the feed region to a point of attachment on the central post 3. Clamping devices 4 that snap-connect to the central post 3 attach the antenna conductors to the central post 3. At the point of attachment where half loop 1 is attached to the central post 3, half loop 1 leads into another section of the antenna conductor, half loop 21, that curves outward on the opposite side of the central post 3 from the point of attachment. At the point of attachment where half loop 2 is attached to the central post 3, half loop 2 leads into another section of the antenna conductor, half loop 22, that curves outward on the opposite side of the central post 3 from the point of attachment.

In FIG. 1 the leads 7 of the twin-lead transmission line are shown cut apart for connection to the ends of half loops 1 and 2. The alligator clips 8 align the ends of half loops 1 and 2 with the leads 7 of the transmission line. The gradual curve of the half loops through the apertures in the flanged disk 6 and the V-taper of the leads 7 of the transmission line provide a smooth transition that tends to reduce voltage standing waves.

Figure 2:
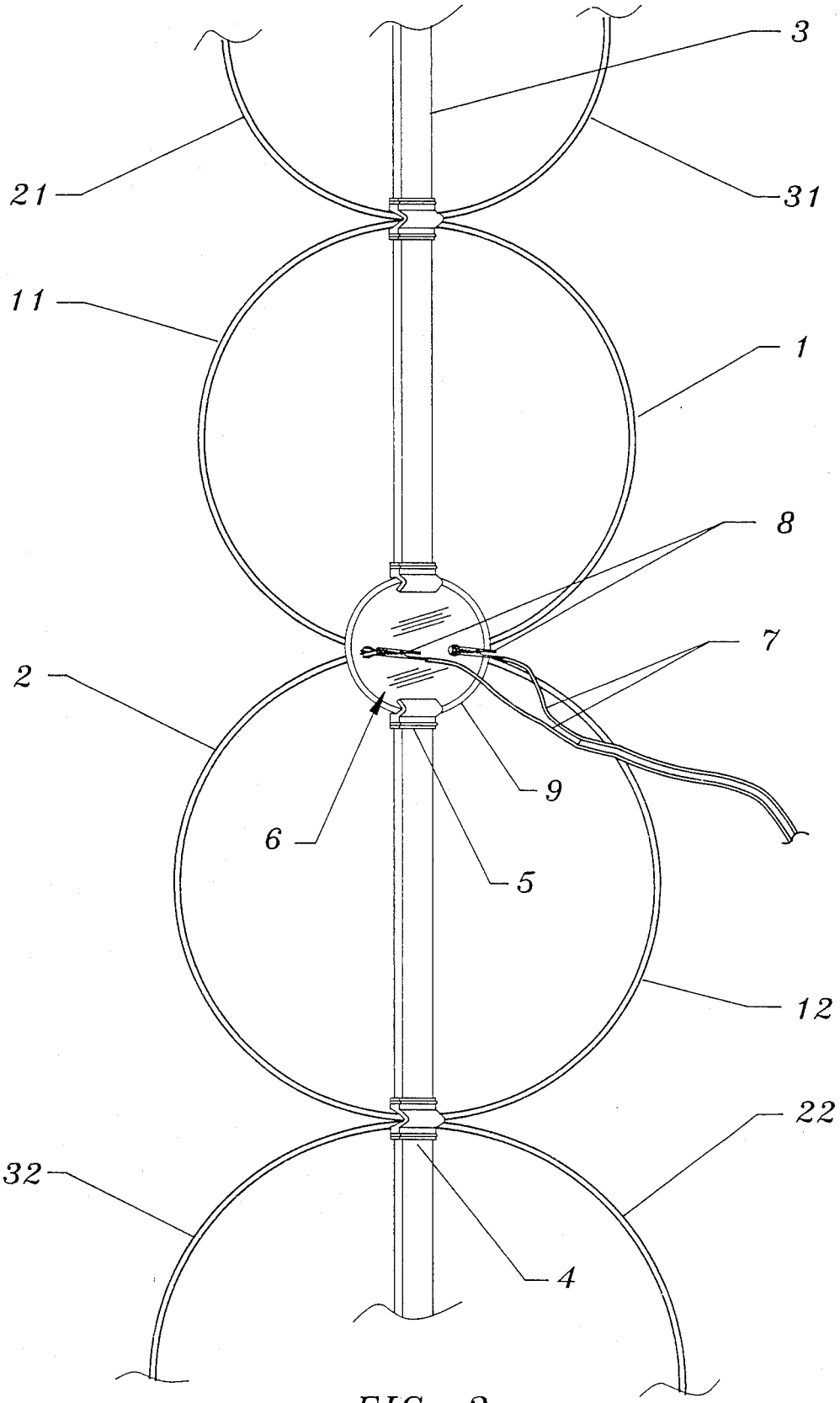
FIG. 2 is a front perspective view of a portion of an alternative antenna incorporating the present invention.

Referring to FIG. 2, another antenna configuration utilizing the subject matter of the invention is shown. The components shown in FIG. 1 are retained. To them are added half loop 11, which is a mirror-image of half loop 1; half loop 12, which is a mirror-image of half loop 2; half loop 31, which is a mirror-image of half loop 21; and half loop 32, which is a mirror-image of half loop 22.

Figure 3:
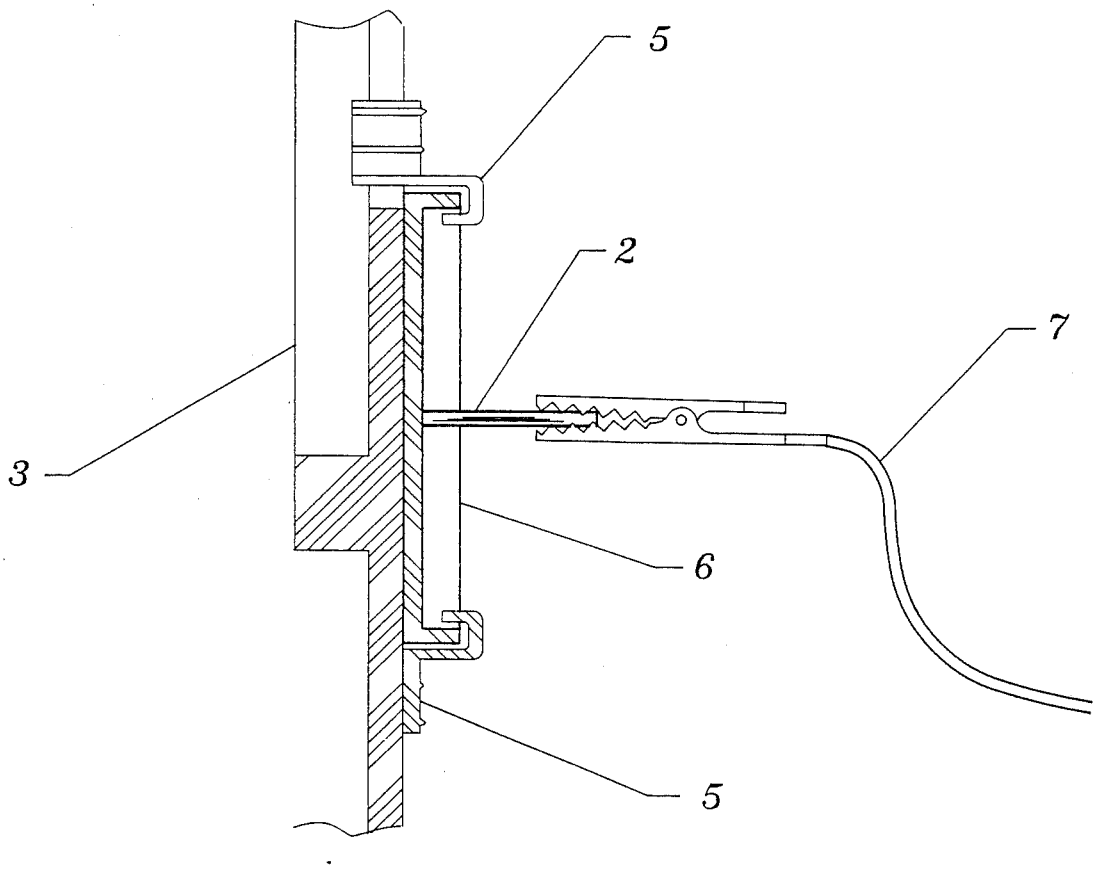
FIG. 3 is a side view of a cut-away section of the antenna of FIG. 1.
Figure 4:
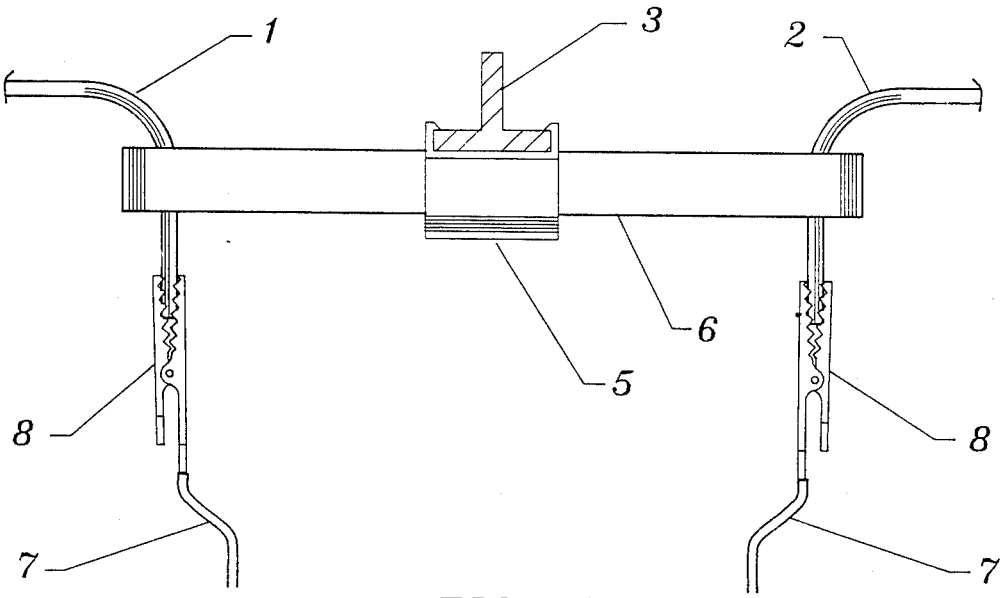
FIG. 4 is a top view of a cut-away section of the antenna of FIG. 1.

Referring to FIGS. 3 and 4, these cut-away sections show details of a preferred embodiment of the invention. As shown in FIGS. 3 and 4, the central post 3 is a fiberglass-reinforced-plastic T-section. The plastic post is an insulator, so the antenna conductors may be fastened directly to it. FIG. 3 shows the notched portions of the clamping devices 5 over the perimeter flange 9 of the flanged disk 6. FIG. 4 generally shows the feed region where the ends of half loops 1 and 2 are bent forward, inserted through apertures in the flanged disk on opposite sides of the central post 3, and inserted end-first into the throats of the alligator clips 8 that are connected to the leads 7 of the twin-lead transmission line.

In the preferred embodiment, the clamping devices 4 and 5 are of a firm, resilient, plastic material. They snap over the edges of the T-section post. The plastic T-section posts and clamping devices 4 are commercially available as a means of supporting electric fences. Each clamping device 5 may be produced by cutting off a section of a clamping device 4, as explained here. Each clamping device 4 consists of identical top and bottom portions that snap around the edges of a T-section post and a notched middle portion. One of the identical portions may be cut away, leaving the notched portion and a portion that snap-connects to the T-section post.

Figure 5A:
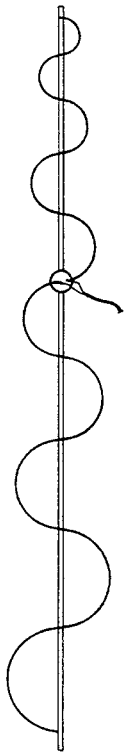
FIGS. 5A through 5D show various antennas incorporating the present invention.
Figure 5B:
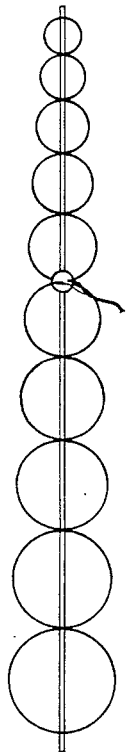
Figure 5C:
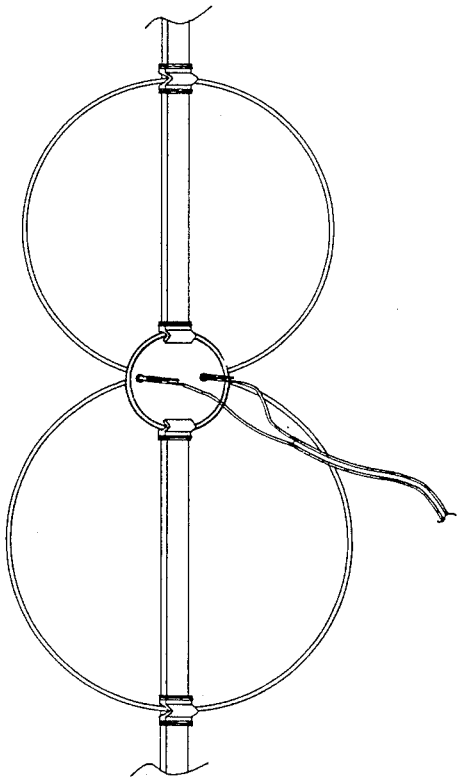
Figure 5D:
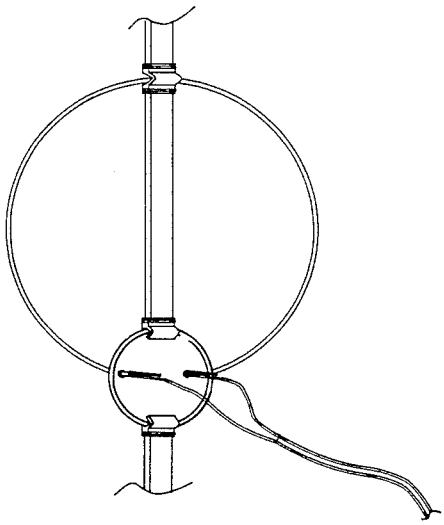

Referring to FIGS. 5A through 5D, these show various configurations of antenna conductors in which half loop sections as claimed are inserted through apertures in flanged disks that are clamped to central posts. FIG. 5A shows two undulated conductors, each comprising a series of half loop sections on alternate sides of the central post, extending above and below the flanged disk 6. FIG. 1 shows the central portion of the configuration depicted in FIG. 5A. FIG. 2 shows the central portion of the configuration depicted in FIG. 5B. FIGS. 5C and 5D show half loop sections on each side of the central post connected together to form whole loops.

Figure 6:
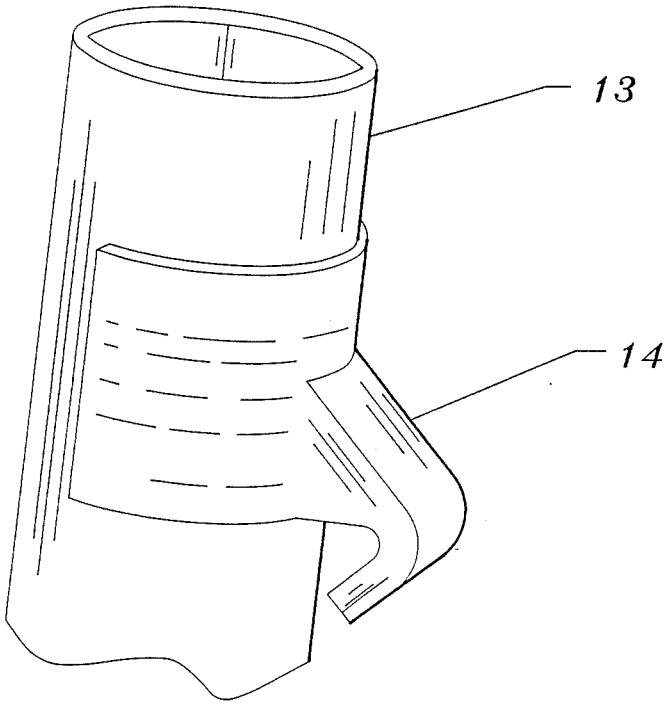
FIG. 6 depicts an alternative clamping device attached to a cylindrical post.
Figure 7:
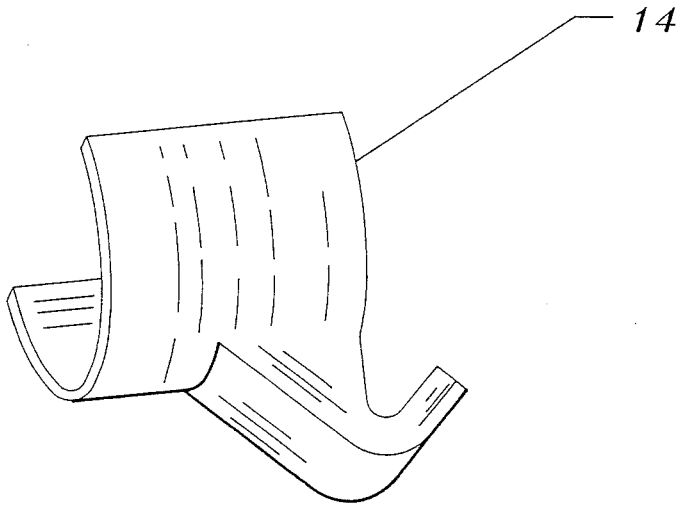
FIG. 7 is another view of the clamping device shown in FIG. 6.

FIGS. 6 and 7 illustrate an alternative to the T-section post 3 and clamping device 5 illustrated in FIGS. 3 and 4. FIG. 6 shows a post 13 of circular cross-section and a C-shaped notched clamping device 14 that snap-connects to the post 13. FIG. 7 shows the C-shape of the clamping device 14.

An antenna as illustrated in FIGS. 1, 3, 4, and 5A has been built for reception of UHF television channel 35—approximately 600 Megahertz. The length of a half wave of a 600-Megahertz signal is approximately 255 millimeters. The antenna comprised five serially connected half loop sections above the feed region and five serially connected half loops below the feed region. The antenna conductors were created from two pieces of soft No. 8 aluminum wire, each piece having a total length of 1275 millimeters. Each half loop was formed by bending a 255 millimeter length of the conductor into a U. A flanged, plastic disk with a diameter of about 75 millimeters, a flange height of about 7 millimeters, and a thickness of about 1 millimeter, was used in that antenna. The apertures in the disk through which the ends of the conductors were inserted were about 6 millimeters from the edges of the disk on a horizontal line through the center of the disk.

In general, the wire for each half loop, if straightened out, would have a length of one-half wavelength of an operating frequency. Where two half loops are joined together to form a whole loop, the length of wire in that whole loop, if straightened out, would have a length of one wavelength of an operating frequency.

I claim:

1. Antenna of wire-like conductors, said conductors including a plurality of half loops connected to a balanced transmission line, each half loop being a section of conductor curved outward from a point of attachment on a central post to an apex removed from said post and then curved back to said post, said antenna including means of supporting said conductors in a feed region and connecting said conductors to said balanced transmission line, said means comprising:

a non-conductive disk having two substantially flat surfaces that are separated from each other by the thickness of the disk, each of said substantially flat surfaces having a circular perimeter, one of said substantially flat surfaces having a raised edge perpendicular to it forming a perimeter flange, the other substantially flat surface of said disk being placed against said post such that said post extends along a diameter of said disk, said disk being fastened to said post by two notched clamping devices that include means for snap-connecting to said post, each clamping device having a notched portion that extends over a portion of said disk, said notched portion of each clamping device having a notch transverse to the length of said post, said perimeter flange of said disk being held in said transverse flange of each clamping device, said disk having two apertures through it, one on either side of said post, an end section of one of said half loops being bent and inserted end-first through one of said apertures of said disk into the throat of an alligator clip that is connected to the end of a lead of said balanced transmission line, an end section of another of said half loops being bent and inserted end-first through the other of said apertures of said disk into the throat of an alligator clip that is connected to the end of the other lead of said balanced transmission line.

2. Antenna as claimed in claim 1 wherein said disk is made of a resilient plastic.

3. Antenna as claimed in claim 1 wherein said clamping devices are made of a resilient plastic.

4. Antenna as claimed in claim 1 wherein the length of the wire in each half loop, if straightened out, is substantially one-half wavelength of an operating frequency.

* * * * *